US006544004B2

(12) United States Patent
Fujii et al.

(10) Patent No.: US 6,544,004 B2
(45) Date of Patent: Apr. 8, 2003

(54) SINGLE-HEADED PISTON TYPE COMPRESSOR

(75) Inventors: Toshiro Fujii, Kariya (JP); Naoya Yokomachi, Kariya (JP); Tatsuya Koide, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 15 days.

(21) Appl. No.: 09/843,405

(22) Filed: Apr. 26, 2001

(65) Prior Publication Data

US 2002/0001524 A1 Jan. 3, 2002

(30) Foreign Application Priority Data

Apr. 28, 2000 (JP) ..... 2000-129891

(51) Int. Cl.[7] ..... F04B 1/26
(52) U.S. Cl. ..... 417/222.2; 417/269; 92/71
(58) Field of Search ..... 417/222.2, 269; 92/71; 277/385

(56) References Cited

U.S. PATENT DOCUMENTS 5,000,666 A * 3/1991 Esaki ..... 417/222.2
6,158,974 A * 12/2000 Tarutani et al. ..... 417/222.2
6,213,727 B1 * 4/2001 Kawaguchi ..... 417/222.2
6,241,483 B1 * 6/2001 Kato et al. ..... 417/222.2
6,290,470 B1 * 9/2001 Okuno et al. ..... 417/269

FOREIGN PATENT DOCUMENTS

JP 2-153272 * 12/1990

* cited by examiner

*Primary Examiner*—Charles G. Freay
*Assistant Examiner*—Michael K. Gray
(74) *Attorney, Agent, or Firm*—Morgan & Finnegan, LLP

(57) ABSTRACT

A compressor which has a housing defining therein a suction chamber, a discharge chamber and a crank chamber, a drive shaft rotatably supported in the housing, a first end of which penetrates through the suction chamber and protrudes from the housing, and a second end of which is disposed in the crank chamber, a single-headed piston accommodated in a cylinder formed in the housing, and a swash plate integrally rotatably mounted on the drive shaft and coupled with the piston. The cylinder is located between the crank chamber and the first end of the drive shaft so that pressure in the crank chamber acts on the drive shaft in an opposite direction of compressive reaction force acting on the drive shaft. A shaft seal is provided on the drive shaft between the suction chamber and the first end of the drive shaft in order to seal the suction chamber.

19 Claims, 7 Drawing Sheets

SINGLE-HEADED PISTON TYPE COMPRESSOR

BACKGROUND OF THE INVENTION

The present invention relates to a swash plate type compressor having a single-headed piston for use in, for example, a vehicle air conditioner.

In a variable displacement swash plate type compressor shown in FIG. 9, in general, a compressor housing is formed such that a front housing 102 and a rear housing 103 are arranged to sandwich a cylinder block 101. A crank chamber 104 is formed between the front housing 102 and the cylinder block 101. A drive shaft 105 across the crank chamber 104 is rotatably supported by the housing. A first end of the drive shaft 105 penetrates through a through hole 106 of the front housing 102, whereas a second end of the drive shaft 105 is in the crank chamber 104. A shaft seal 107 is arranged to seal a gap between the drive shaft 105 and the front housing 102, thereby preventing refrigerant in the crank chamber 104 from leaking out. A plurality of cylinder bores 108 are formed in the cylinder block 101 to surround the drive shaft 105. A piston 109 is disposed in each of the cylinder bores 108 and reciprocates there. A suction chamber 110 and a discharge chamber 111 are formed in the rear housing 103.

A swash plate 113 is mounted on the drive shaft 105 through a hinge mechanism 112 and rotates together with the drive shaft 105. The swash plate 113 is capable of sliding in the axial direction of the drive shaft 105 and of inclining with respect to the drive shaft 105. Each piston 109 is engaged with an outer peripheral portion of the swash plate 113 through a pair of shoes 114 so that the rotational movement of the drive shaft 105 is converted to the reciprocating movement of the piston 109. Refrigerant in the suction chamber 110 is drawn into the cylinder bore 108 and compressed there by the reciprocating piston 109. When pressure in the crank chamber 104 is adjusted, an inclination angle of the swash plate 113 changes. Therefore, the piston stroke changes. Accordingly, the discharge capacity of the compressor becomes variable. For example, the inclination angle of the swash plate 113, the angle between a plane perpendicular to the drive shaft 105 and the swash plate 113, decreases when the pressure in the crank chamber 104 increases. Reduction of the piston stroke decreases the discharge capacity of the compressor.

During operation of the compressor, compressive reaction force of each piston 109 acts on the drive shaft 105 through the swash plate 113. On the other hand, pressure difference between the pressure Pc in the crank chamber 104 and the atmospheric pressure $P_0$, which is multiplied by a cross-sectional area of the drive shaft 105 substantially at which the shaft seal 107 is provided, acts on the drive shaft 105. Both the reaction force and the pressure difference intend to push the drive shaft 105 frontwards. The thrust load based on the reaction force and the pressure difference is supported by the front housing 102 through a thrust bearing 116 arranged between a rotor 115 or lug plate and the front housing 102.

In recent years, a compressor has been proposed for use in a refrigerant circuit which employs a refrigerant gas such as carbon dioxide, instead of chloro-fluoro carbon. Such a circuit, after compression of the gas, cools down the gas in a super critical range that exceeds a critical temperature of the gas. For example, according to Japanese Patent Application Publication No. 11-223179 discloses a variable displacement type of compressor employing carbon dioxide as refrigerant. In this compressor, refrigerant in a discharge pressure region supplied into the crank chamber 104 is controlled by an electric displacement control valve 117 as shown conventionally in FIG. 9. The amount of refrigerant passing through the refrigerant circuit is adjusted based on the external data such as a heat load.

When the circuit employs chloro-fluoro carbon as refrigerant, the pressure Pc in the crank chamber is relatively small, less than or equal to $9.8\times10^5$ Pa. However, when the refrigerant such as carbon dioxide is employed, the pressure Pc in the crank chamber rises greatly. For example, employment of carbon dioxide raises the pressure Pc higher than the pressure in employment of chloro-fluoro carbon by about several tens to a hundred $\times10^4$ Pa. As a result, the thrust load supported by the thrust bearing 116 increases greatly, and sealing function of the shaft seal 107 against the high pressure is required.

When the thrust load acting on the drive shaft 105 in the same direction as the compressive reaction force becomes higher, mechanical loss increases as well as the power consumption to drive the drive shaft 105. The power consumption is typically apparent when the power of the drive source such as an engine is transmitted to the drive shaft 105 without using a clutch, for instance, in a clutchless variable displacement type of swash plate compressor. That is, when the compressor is driven in a minimum capacity state or off-drive state, the power consumption, which should be minimum, increases.

Further, when the shaft seal 107 is arranged in the crank chamber region, the lubrication of the shaft seal 107 is not satisfactorily performed because refrigerant in the crank chamber has not only high pressure but high temperature.

SUMMARY OF THE INVENTION

Accordingly, it is a first object of the present invention to provide a swash plate type compressor in which required power to drive the compressor is reduced by reducing a thrust load in the same direction as compressive reaction force acting on a drive shaft.

To achieve the above first object, a swash plate type compressor of the present invention has a housing including a suction chamber, a discharge chamber and a crank chamber, a drive shaft rotatably supported by the housing, the drive shaft having a first end protruding from the housing and a second end disposed in the crank chamber, a cylinder bore defined between the crank chamber and the first end of the drive shaft, a single-headed piston disposed in the cylinder bore to be reciprocated, and a cam plate rotatably mounted on the drive shaft in the crank chamber, the cam plate being operatively engaged with the piston, whereby rotational movement of the drive shaft is converted to reciprocating movement of the piston through the cam plate.

In the present invention, when refrigerant is compressed during operation of the compressor, the compressive reaction force of the piston acts on the drive shaft through the cam plate thereby pushing the drive shaft toward its second end. On the other hand, pressure in the crank chamber acts on the second end portion of the drive shaft against atmospheric pressure acting on the first end of the drive shaft so that pressure difference between them pushes the drive shaft in the opposite direction to the reaction force. Therefore, according to the present invention the power to drive the drive shaft of the compressor is reduced by reduction of thrust force acting on the drive shaft.

It is a second object of the present invention to provide a swash plate type compressor in which a shaft seal arranged to seal a gap between a drive shaft and a housing is improved.

To achieve the above second object according to the present invention, the suction chamber is in the housing defined adjacent to the first end of the drive shaft. The drive shaft is arranged in the housing such that the first end of the drive shaft penetrates the suction chamber and protrudes from the housing. A shaft seal is arranged between the suction chamber and the first end of the drive shaft, thereby sealing the suction chamber.

The foregoing shaft seal arrangement of the present invention simply requires resistance against pressure difference between atmospheric pressure and suction pressure which is lowest in the compressor. Accordingly, durability of the shaft seal is sufficiently extended, and sealing function thereof is improved. This is apparently effective when carbon dioxide and the like is employed as refrigerant instead of chloro-fluoro carbon, because carbon dioxide is used in its high pressure range, super critical range. The pressure in the crank chamber of the variable displacement compressor is to be higher than that of the fixed displacement compressor. Accordingly, the variable displacement compressor according to the present invention is more effective than the fixed displacement compressor according to the present invention because carbon dioxide is used in its high pressure range, super critical range.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

FIG. 2(*b*) is a cross-sectional view as seen from line IIb—IIb in FIG. 2(*a*), where a front housing is omitted;

DETAILED DESCRIPTION OF THE PREFERRED EMBODIMENTS

The present invention is applied to a variable displacement compressor for a vehicle air conditioner. An embodiment according to the present invention will now be described with reference to FIGS. 1 and 2.

Figure 1:
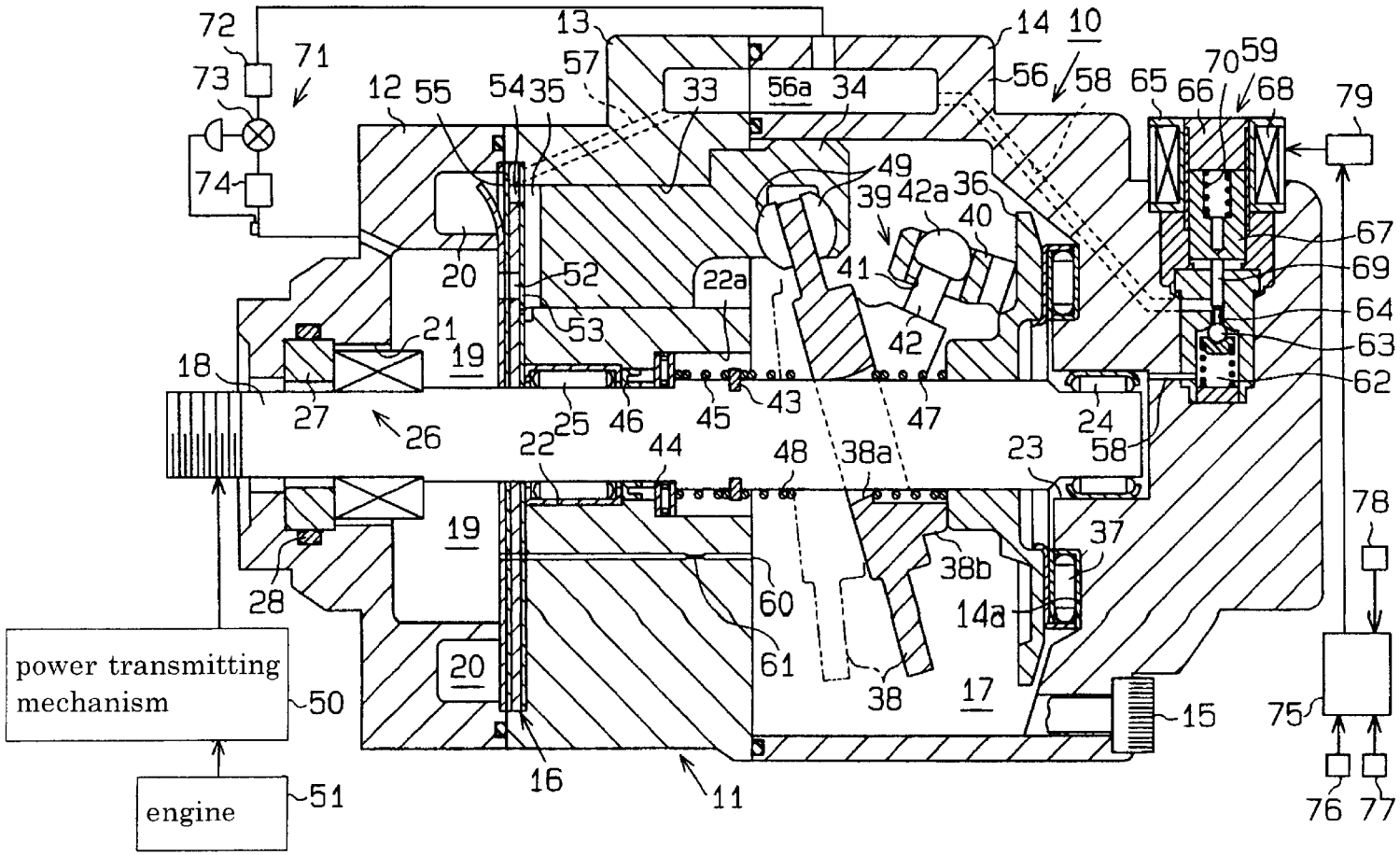
FIG. 1 is a cross-sectional view illustrating a variable displacement type of compressor according to a preferred embodiment of the present invention.

As shown in FIG. 1, a front housing 12, a cylinder block 13 and a rear housing 14 constitute a housing 11 of a compressor 10. These members are arranged from front to rear (left to right in FIG. 1), and secured by a plurality of through bolts 15 (only one through blot is illustrated). A valve plate assembly 16 is arranged between the front housing 12 and the cylinder block 13. A crank chamber 17 is defined between the cylinder block 13 and the rear housing 14.

A drive shaft 18 is rotatably supported by the housing 11. A first end of the drive shaft 18 protrudes from the front housing 12, and a second end of the drive shaft 18 is disposed in the crank chamber 17. In the front housing 12 a suction chamber 19 is formed around the drive shaft 18, and an annular discharge chamber 20 is formed to surround the suction chamber 19. A recess 21 is formed at a central inner wall of the front housing 12 adjacent the suction chamber 19. An axial hole 22 is formed in the cylinder block 13 to communicate the crank chamber 17 with the suction chamber 19. A recess 23 is formed in the rear housing 14 facing the crank chamber 17. The recess 23 supports the second end of the drive shaft by means of a radial bearing 24.

The drive shaft is further supported at its intermediate portion by the cylinder block 13 through a radial bearing 25 arranged in the axial hole 22.

Figure 2A:
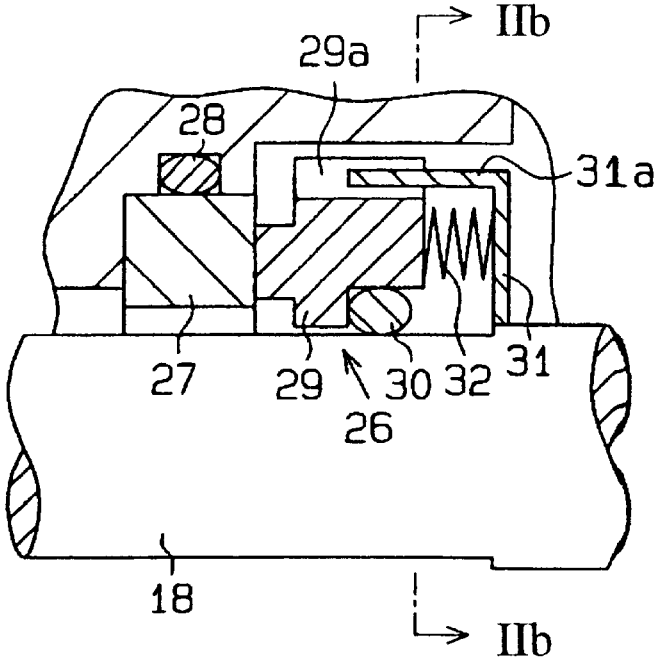
FIG. 2(*a*) is an enlarged partial cross-sectional view illustrating a shaft seal of the compressor.
Figure 2B:
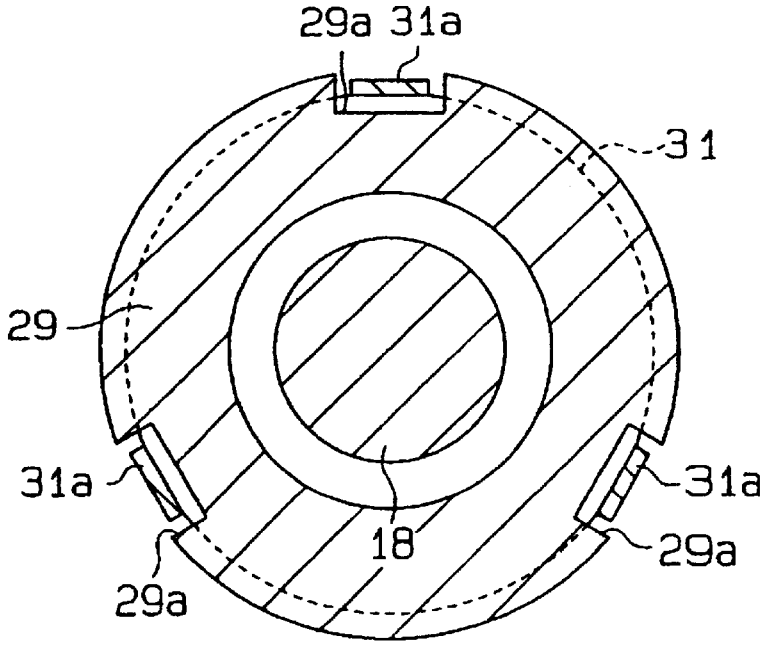

A shaft seal 26 is disposed in the recess 21 of the front housing 12. As shown in FIG. 2(*a*), the shaft seal 26 includes a ring 27 fitting in the recess 21 of the front housing 12 and a sliding ring 29 made of carbon. The sliding ring 29 is mounted on the drive shaft 18 through an O-ring 30 such that the sliding ring 29 rotates integrally with the drive shaft 18 and slides against the ring 27. The ring 27 is loosely mounted around the drive shaft 18, and the O-ring 28 is arranged between the ring 27 and the front housing 12. The rings 27 and 29 each have a sliding contact surface perpendicular to the drive shaft 18. The ring 29 is urged to the ring 27 by a spring 32. The sliding contact of the rings 27 and 29 conducts the sealing function of the shaft seal. As shown in FIG. 2(*b*), three grooves 29*a* are formed at an outer periphery of the sliding ring 29. The shaft seal 26 has a support ring 31 which integrally rotates with the drive shaft 18. The support ring 31 has three hooks 31*a* engaging with the respective grooves 29*a*. A spring 32 urging the sliding ring 29 toward the ring 27 is provided between the support ring 31 and the sliding ring 29. The O-ring 30, the sliding ring 29, the ring 27 and the O-ring 28 together seal a gap or clearance between the drive shaft 18 and the housing 11.

A plurality of cylinder bores 33 (only one cylinder bore is illustrated in FIG. 1) are formed in the cylinder block 13 around the drive shaft 18 so that the cylinder bores 33 are located at front side of the crank chamber, or between the crank chamber 17 and the first end of the drive shaft 18. A single-headed piston 34 is disposed in each of the cylinder bores 33 and reciprocates there. A compression space or chamber 35 is defined in the cylinder bore 33 by the valve plate assembly 16 and the piston 34. The compression chamber 35 changes its capacity in accordance with the reciprocating movement of the piston 34, thereby defined the refrigerant is compressed.

A lug plate 36 as a rotor is mounted on and integrally rotatably with the drive shaft 18 in the crank chamber 17. The lug plate 36 is supported by an inner wall surface 14*a* of the rear housing 14 through a first thrust bearing 37. The axial load by the compressive reaction force is received by the inner wall surface 14*a* of the housing 11 so that the inner wall surface 14*a* functions as a regulating surface regulating the position of the drive shaft 18 in the axial direction.

A swash plate 38 as a cam plate arranged in the crank chamber 17 has a through hole 38*a* through which the drive shaft 18 penetrates. A hinge mechanism 39 is arranged between the lug plate 36 and the swash plate 38. The hinge mechanism has a pair of support arms 40 (only one support arm is illustrated in FIG. 1) protruding from a front surface of the lug plate 36, guide holes 41 each formed in the respective support arms 40, and a pair of guide pins 42 (only one guide pin is illustrated) fixed to the swash plate 38. Each guide pin 42 has at its distal end a spherical portion 42*a* engaged with the guide hole 41. The swash plate 38 is supported by the drive shaft 18 through the hinge mechanism 39, and is rotatable together with the lug plate 36 and the drive shaft 18. The swash plate 38 is further inclinable with respect to the drive shaft 18, and is slidable in the axial direction of the drive shaft 18 by means of the hinge mechanism 39. A counter weight portion 38*b* is formed integrally with the swash plate 38 at the opposite side to the hinge mechanism 39 with respect to the drive shaft 18.

A circular clip 43 is fixed to the drive shaft 18, such that the clip 43 positions within a large diameter portion 22*a* of the axial hole 22. A thrust bearing 44 is disposed in the large diameter portion 22*a*. A first coil spring 45 is arranged around the drive shaft 18 between the clip 43 and the thrust bearing 44. The coil spring 45 urges the drive shaft 18, thereby urging the lug plate 36 toward the inner wall surface 14*a* of the rear housing 14.

A seal or a sealing ring 46 is arranged in the axial hole 22 to seal a gap between the outer peripheral surface of the drive shaft 18 and the cylindrical inner surface of the axial hole small diameter portion. The sealing ring 46 prevents gas in the crank chamber from leaking into the suction chamber through the axial hole 22. The sealing ring 46 is made of rubber or fluoroprastic resin, and its cross-section is U-shape, lip-shape or the like.

A second coil spring 47 to reduce the inclination angle of the swash plate 38 is arranged around the drive shaft 18 between the lug plate 36 and the swash plate 38. The coil spring 47 urges such that the swash plate 38 approaches the cylinder block 13 or reduces its inclination angle.

A third coil spring 48 as a return spring is arranged around the drive shaft 18 between the swash plate 38 and the clip 43. When the swash plate 38 is in its large inclination angle state as shown with a solid line in FIG. 1, the third coil spring 48 does not urge the swash plate 38 because of natural length of the third coil spring 48. On the other hand, when the swash plate 38 is in its small inclination angle state as shown with two dot chain line in FIG. 1, the third coil spring 48 is contracted between the swash plate 38 and the clip 43. In this state the third coil spring 48 urges the swash plate 38 away from the cylinder block 13 and increases the inclination angle of the swash plate.

The piston 34 engages with the periphery of the swash plate 38 through a pair of shoes 49 so that the rotational movement of the swash plate 38 accompanied by the rotation of the drive shaft 18 is converted to the reciprocating movement of the piston 34 through the shoes 49. The swash plate 38 and the shoes 49 are made of steel. Surface treatments such as thermally spraying or frictionally welding aluminum or aluminum alloy is performed on the sliding portion of the swash plate 38, on which the shoes 49 slide, to prevent their seizure.

The drive shaft 18 is operatively connected to an engine 51 as a drive source through a power transmitting mechanism 50. The power transmitting mechanism 50 may be a clutch mechanism such as magnetic clutch which selectively connects and disconnects the drive shaft 18 with the engine. The power transmitting mechanism 50 may be a clutchless mechanism such as a belt and a pulley which always connects the drive shaft to the engine 51. In this embodiment a clutchless type of the power transmitting mechanism 50 is applied.

On the valve plate assembly 16, a suction port 52, a suction valve 53 which opens and closes the suction port 52, a discharge port 54, and a discharge valve 55 which opens and closes the discharge port 54 are formed corresponding to the respective cylinder bore 33. The suction chamber 19 and the cylinder bore 33 are communicated with each other through the suction port 52. The cylinder bore 33 and the discharge chamber 20 are communicated with each other through the discharge port 54. The refrigerant gas in the suction chamber 19 is drawn into the cylinder bore 33 through the suction port 52 while opening the suction valve 53 by the movement of the piston 34 from its top dead center to bottom dead center. The refrigerant gas in the cylinder bore 33 is compressed to predetermined pressure, and discharged into the discharge chamber 20 through the discharge port 54 while opening the discharge valve 55 by the movement of the piston 34 from its bottom dead center to top dead center.

A muffler 56 having a chamber 56*a* is formed on an outer periphery of the housing 11 in such a manner that the muffler lies from the cylinder block 13 to the rear housing 14. The muffler chamber 56*a* is communicated with the discharge chamber 20 through a discharge passage 57 formed in the cylinder block 13. The muffler functions to expand gas in the muffler chamber 56*a*, and to reduce the pulsation of the gas discharged out of the discharge chamber 20.

A supply passage 58 as a control passage is formed to communicate the muffler chamber 56*a* with the crank chamber 17. A control valve 59 is arranged in the supply passage 58. The opening degree of the supply passage 58 is adjusted by the control valve 59. In this embodiment the muffler 56 is arranged downstream the discharge chamber 20. An end of the supply passage 58 opens to the crank chamber where the radial bearing 24 is disposed. The bearing 24 is therefore lubricated by the gas which includes oil mist. The supply passage functions to add the discharge pressure to the second end of the drive shaft 18. A bleeding passage 60 is formed in the cylinder block 13 and the valve plate assembly 16 to communicate the crank chamber 17 with the suction chamber 19. An orifice 61 is arranged in the bleeding passage 60.

The control valve 59 is a magnetic valve. The valve 59 includes a valve chamber 62, a valve spherical body 63 disposed in the valve chamber 62, a valve hole 64 opened to the valve chamber 62 and a solenoid 65. The valve chamber 62 and the valve hole 64 constitute a part of the supply passage 58.

The solenoid 65 includes a stator core 66, a movable core 67 and a coil 68 and a rod 69 operatively connecting the movable core 67 and the valve body 63. A spring 70 urges the movable core 67 and the rod 69 toward the valve body 63 so that the valve body 63 opens the valve hole 64. The coil 68 is arranged to surround the stator core 66 and the movable core 67. When the solenoid 65 is excited, a magnetic force is produced between the stator core 66 and the movable core 67. The movable core 67 moves against the spring 70, and the rod 69 and the valve body 63 are urged by another spring in the valve chamber 62 and close the valve hole 64. When the solenoid 65 is de-excited, the movable core 67 and the rod moves toward the valve body 63 by the spring 70, and the valve body 63 opens the valve hole 64.

The suction chamber 19 and the muffler chamber 56*a* are communicated through an external refrigerant circuit 71 which includes a condenser 72, an expansion valve 73 and an evaporator 74. The external refrigerant circuit 71 and the above described variable displacement compressor constitute a refrigerant circuit for a vehicle air conditioner. In this embodiment carbon dioxide is applied as refrigerant gas.

Provided is a controller 75 which determines a current value to a drive circuit 79 for the solenoid 65 due to external signal such as actual temperature obtained by a temperature sensor 76 disposed in a vehicle compartment, pre-set temperature by a temperature setting device 77 disposed in the vehicle compartment, rotational speed of the engine 51 from a speed sensor 78. The drive circuit 79 outputs the current value to the coil 68 of the control valve 59.

The operation of the above described compressor will be described.

The swash plate 38 rotates integrally with the drive shaft 18 through lug plate 36 and the hinge mechanism 39. The rotational movement of the swash plate 38 is converted to the reciprocating movement of the piston 34 through the respective shoes 49. During the compressor operation, the refrigerant gas returns to the suction chamber 19 from the external refrigerant circuit 71. The refrigerant is drawn through the port 52, compressed in and discharged through the port 54 from the compression chamber 35, continuously. The refrigerant discharged to the discharge chamber 20 is sent to the external refrigerant circuit 71 through the discharge passage 57 and the muffler chamber 56*a*.

The control valve 59 adjusts the opening degree of the supply passage 58 in accordance with a cooling load. For example, when temperature detected by the temperature sensor 76 is higher than pre-set temperature set by a temperature setting device 77, the controller 75 estimates cooling requirement large and determines a corresponding current value given to the solenoid 59. The controller 75 operates the drive circuit 79 to drive the solenoid 65 of the control valve 59. The drive circuit 79 supplies the current determined by the controller 75 to the coil 68. According to the solenoid energized the valve body 63 moves against the spring 70 and closes the valve hole 64. The opening degree of the supply passage 58 is therefore reduced.

When introduction of the discharge pressure to the crank chamber 17 is reduced, the pressure in the crank chamber 17 gradually becomes small because the refrigerant flows through the bleeding passage 60 to the suction chamber 19. As a result, the pressure difference between the crank chamber pressure and the cylinder bore pressure or the suction pressure is reduced, and the inclination angle of the swash plate 38 increases. Accordingly, the piston stroke increases, and the discharge capacity also increases.

On the contrary, when temperature detected by the temperature sensor 76 comes close to the pre-set temperature of the temperature setting device 77, the controller 75 estimates the cooling requirement small and directs the drive circuit 79 to de-energize the solenoid 65 of the control valve 59. The drive circuit 79 then stops supplying the current to the coil 68. Accordingly, the valve body 63 moves to open the valve hole 64, and the opening degree of the supply passage 58 increases.

When introduction of the discharge pressure to the crank chamber 17 pressurizes there, the difference between the crank chamber pressure and the suction pressure increases, and the inclination angle of the swash plate 38 therefore decreases. Accordingly, the piston stroke decreases, and the discharge capacity also decreases.

When the piston 34 compresses the refrigerant gas, compressive reaction force F1 by the piston 34 acts on the drive shaft 18 through the shoes 49, the hinge mechanism 39 and the lug plate 36. The reaction force is finally received by the receiving surface of the rear housing 14. Crank chamber pressure Pc acts on the second end of the drive shaft 18 frontward, an opposite direction of the compressive reaction force. External pressure (atmospheric pressure $P_0$) which is smaller than the pressure Pc in the crank chamber 17 acts on the first end of the drive shaft 18 in the same direction as the reaction force. When pressure difference $Pc-P_0$ multiplied by the cross-sectional area S of the drive shaft 18 at the position of which the sealing ring 46 is provided denotes force F2 or $F2=(Pc-P_0)\times S$, the force F2 acts on the drive shaft 18 against the reaction force F1. Conventionally, the reaction force F1 and the pressure based force F2 were in the same direction. However, in the present invention the force F2 works in the opposite direction to the reaction force F1. Accordingly, some thrust load received by the bearing 37 is cancelled, and the power to drive the drive shaft 18 is reduced because of reduction of bearing friction.

When carbon dioxide is applied as refrigerant instead of chloro-fluoro carbon, the pressure Pc of carbon dioxide becomes higher than the pressure of chloro-fluoro carbon by about from several tens to a hundred$\times 10^4$ Pa. Therefore, in the conventional constitution a large thrust force might act on the drive shaft 18 if carbon dioxide is employed. However, in the present invention the drive force is sharply reduced because the force F2 by the pressure in the crank chamber 17 contradicts the reaction force F1.

In the crutchless type of compressor, even while the air conditioner stops, the rotation of the engine 51 is transmitted to the drive shaft 18, so called off-drive of the compressor. At this time, the inclination angle of the swash plate 38 is minimum, and the reaction force acts on the drive shaft 18 by the minimum movement of the piston 34. However, as above described, the force F2 due to the pressure deference $Pc-P_0$ acts on the drive shaft 18 to contradict the reaction force, the power consumption is reduced when the off-drive of the compressor is performed.

While the drive shaft 18 rotates, the compressive movement of the piston 34 is accompanied by the swash plate 38. The reaction force urges the drive shaft 18 toward the rear housing 14. The lug plate 36, which contacts the thrust bearing 37, is also urged toward the receiving surface (the inner wall surface 14*a*) regulating the drive shaft position in the axial direction. However, while the compressor stops and the reaction force of the piston 34 does not act on the drive shaft 18, pressure in the crank chamber 17 urges the drive shaft 18 frontward because the pressure in the crank chamber is normally higher than the atmospheric pressure. When the compressor starts, the frontwardly urged drive shaft 18 may cause to generate noise due to collision between the thrust bearing and the lug plate. However, in this embodiment the first coil spring 45 always urges the drive shaft 18 to the rear housing 14 so that the lug plate 36 maintain its contact with the thrust bearing 37 while the compressor 10 stops. Accordingly, when the compressor starts again, noise is reduced because the lug plate 36 does not collide with the thrust bearing 37. The urging force of the first coil spring 45 is so determined that the force overcomes the pressure difference $Pc-P_0$ and slightly urges the lug plate 36 to the thrust bearing 37. Therefore, the urging force does not influence the drive force of the drive shaft 18.

In this embodiment following effects may be obtained.

(1) Compared with the conventional compressor in which both the forces act in the same direction, the foregoing compressor sharply reduces the power to drive the drive shaft 18 since the force, which is proportional to the difference between the pressure in the crank chamber 17 and the atmospheric pressure, acts on the drive shaft 18 in the opposite direction to the reaction force of the piston. Furthermore, the crank chamber pressure against the reaction force reduces friction at the thrust bearing 37. Therefore, the durability of the thrust bearing 37 is improved. When carbon dioxide is applied as refrigerant instead of chloro-fluoro carbon, the above effect is remarkably obtained.

(2) The first end of the drive shaft 18 penetrates through the suction chamber 19 and protrudes from the housing 11. The shaft seal 26 requires only sealing force to endure the difference between the suction pressure which is the lowest in the compressor and the atmospheric pressure, whereas the shaft seal in the conventional compressor needs to endure the difference between the crank chamber pressure which may be the highest in the compressor and the atmospheric pressure. Accordingly, the shaft seal arrangement according to the present invention endures longer than the shaft seal arrangement of the conventional compressor. Compared to the conventional shaft seal, the shaft seal 26 is disposed in lower temperature region, the suction chamber. Therefore, the endurance of the shaft seal 26 is further improved. The mist oil in the refrigerant returning from the external circuit to the suction chamber 19 is smoothly supplied between the ring 27 and the sliding ring 29, thereby improving the quality of the shaft seal.

(3) The sliding ring 29 is always urged by the spring 32 to the ring 27 through their respective sliding contact surfaces perpendicular to the drive shaft. Accordingly, even if the sliding contact surface is worn, the ring 27 and the sliding ring 29 maintain their contacts, therefore, maintain sufficient sealing function.

(4) The inner wall surface 14*a* of the rear housing receives the thrust load by the reaction force of the piston 34 and regulates the position of the drive shaft 18 in the axial direction. The lug plate 36 is urged toward the thrust bearing 37 by the first coil spring while the compressor 10 stops. Accordingly, vibrations or noise due to shaking of the drive shaft 18 is prevented when the drive shaft 18 starts again. Because the relative movement between the seal ring 46 and the drive shaft 18 is prevented, foreign substances are prevented from entering between the seal ring 46 and the drive shaft 18. Therefore, the seal ring 46 is prevented from deteriorating at an early stage of its use, and the endurance of the compressor is improved.

(5) The swash plate 38 is rotatable integrally with drive shaft 18 through the lug plate 36 fixed to the drive shaft 18 and the hinge mechanism 39, and is inclinable with respect to the drive shaft 18. The inclination angle of the swash plate 38 is adjusted simply in accordance with the pressure in the crank chamber 17. Accordingly, the compressor 10 runs at its proper discharge capacity by the inclination angle of the adjustment of the swash plate which is accompanied by the cooling load.

(6) The control passage to introduce the discharge pressure to the crank chamber 17 is formed. The opening degree of the control passage is adjusted by the control valve 59 arranged in the control passage, and the pressure in the crank chamber 17 is adjusted. Accordingly, the pressure in the crank chamber 17 is adjusted easily by the control valve 59.

(7) Compared to the conventional so called inner control valve having pressure sensitive mechanism such as bellows or a diaphragm which moves by the suction pressure and which adjusts an opening degree of the supply passage, the magnetic valve as the control valve according to the present invention smoothly adjusts its opening degree by using the external electric signals, thereby adjusting the pressure Pc in the crank chamber 17.

(8) The control valve 59 is arranged in the rear housing, and isolated from the discharge chamber 20 formed in the front housing. Accordingly, the control valve 59 is not influenced by high temperature of the discharge gas. Therefore, the solenoid 65 is prevented from raising its temperature, and the control valve operates accurately.

(9) Since the control valve 59 is arranged at the downstream of the muffler 56, the refrigerant supplied to the control valve 59 has substantially no pulsation, therefore prevents the valve from hunting. Accordingly, the pressure Pc in the crank chamber 17 is improved in accuracy.

(10) Since the muffler 56 is arranged between the discharge chamber in the front housing and the control valve in the rear housing which is preferably away from the discharge chamber, manufacture of the housing 11 and machining of the control passage between the muffler 56 and the crank chamber 17 through the control valve are performed easily.

(11) The sealing ring 46 arranged in the axial hole 22 to seal between the drive shaft 18 and the cylinder block 13 prevents the refrigerant gas in the crank chamber 17 from leaking through the axial hole 22. As a result, the refrigerant gas in the crank chamber 17 bleeds into the suction chamber 19 only through the bleeding passage 60. Therefore, the pressure in the crank chamber 17 is adjusted in high accuracy when the discharge capacity is changed.

(12) The orifice 61 is useful to restrict the bleeding gas amount because it is hard to machine the entire bleeding passage 60 with a predetermined diameter which should be severely provided when the compressor employs carbon dioxide as refrigerant gas which causes higher pressure in the housing than chloro-fluoro carbon.

(13) The clutchless compressor according to this embodiment is always driven, regardless of need of its operation, whenever the engine runs. However, this compressor generates no vibration and noise caused by clutch ON and OFF. Moreover, the power consumption is small for the reason mentioned in the effect (1).

(14) Since the lubricating passage or the control passage opens to the crank chamber 17 where the radial bearing 24 is provided, the oil mist involved in the gas lubricates the radial bearing 24 whenever the gas flows into the crank chamber through the passage.

(15) The control passage is applied as the lubricating passage. Accordingly, separate fabrication of the lubricating passage for the radial bearing 24 is not necessary.

(16) The first coil spring 45 isolates from the third coil spring 48. Accordingly, each spring force of the coil springs 45 and 48 according to the embodiment is adjusted more easily than each spring force of the coil springs 45 and 48 formed integrally.

The present invention may be modified as follows.

Figure 3:
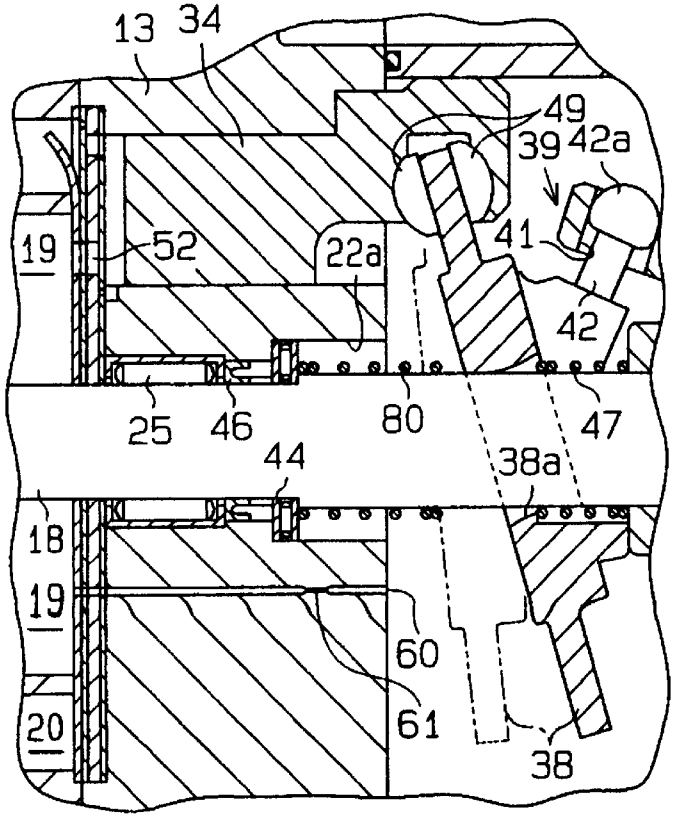
FIG. 3 is a partial cross-sectional view illustrating a middle portion of the compressor according to the present invention.

The first coil spring 45 urging the drive shaft 18 against the inner wall surface 14*a* and the third coil spring 48 urging the swash plate 38 rearward to increase the inclination angle with respect to the drive shaft 18 may be integrally formed as a single coil spring 80 arranged between the thrust bearing 44 and the swash plate 38, as shown in FIG. 3. In this case the number of assembled parts is reduced, and time and process of assembling is also reduced. When the swash plate 38 is nearly in the maximum inclination angle state, the contact between the coil spring 80 and the swash plate 38 is removed. That is, when the compressive reaction force is the maximum, the coil spring 80 does not urge the swash plate 38 in the same direction as the reaction force. Accordingly, the drive force is reduced. The coil spring 80 may, however, always urge the swash plate 38 if so desired.

While the compressor 10 is driven, the thrust load is received by the rear housing through the first thrust bearing 37. The second thrust bearing 44 prevents the front end of the coil spring 45 or 80 from being worn due to its sliding contact with the cylinder block 13. The drive shaft 18 and the coil spring 45 or 80 rotate integrally and smoothly by the second thrust bearing 44. The thrust bearing 44 which the front end of the coil spring 45 or 80 contacts can, however, be omitted. The coil spring 45 or 80 may be directly supported by a step portion of the axial hole 22.

The orifice 61 of the bleeding passage 60 can be omitted when the bleeding passage 60 is formed at a predetermined diameter by which the bleeding amount is controlled.

The radial bearing 25 may be applied as an orifice by eliminating the sealing ring 46 in the axial hole 22 and adjusting the diameter of the axial hole 22. In this case, the bleeding passage 60 is not needed.

Figure 4:
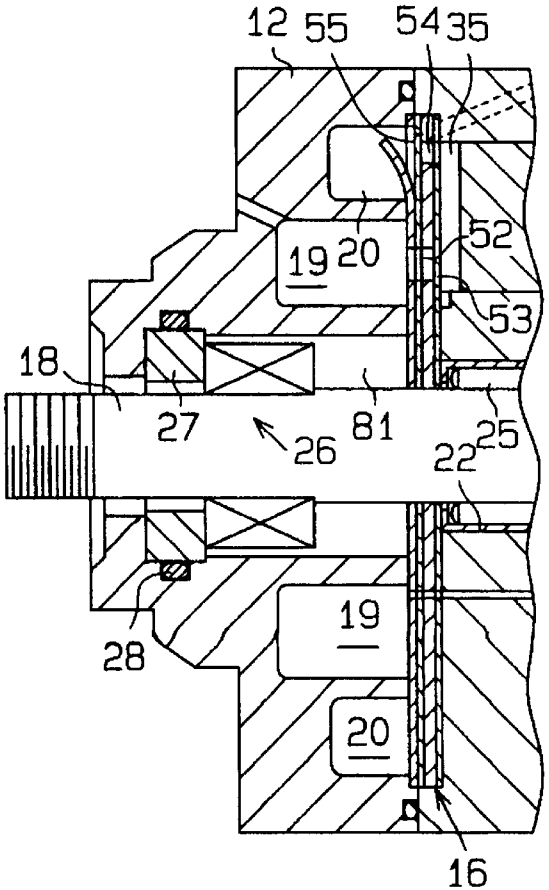
FIG. 4 is a partial cross-sectional view illustrating a front portion of the compressor according to the present invention.

The drive shaft 18 does not necessarily penetrate the suction chamber 19. As shown in FIG. 4, an annular suction chamber 19 may be formed in the front housing 12, and the through hole 61 for the drive shaft 18 may be formed inside the suction chamber 19.

Figure 5:
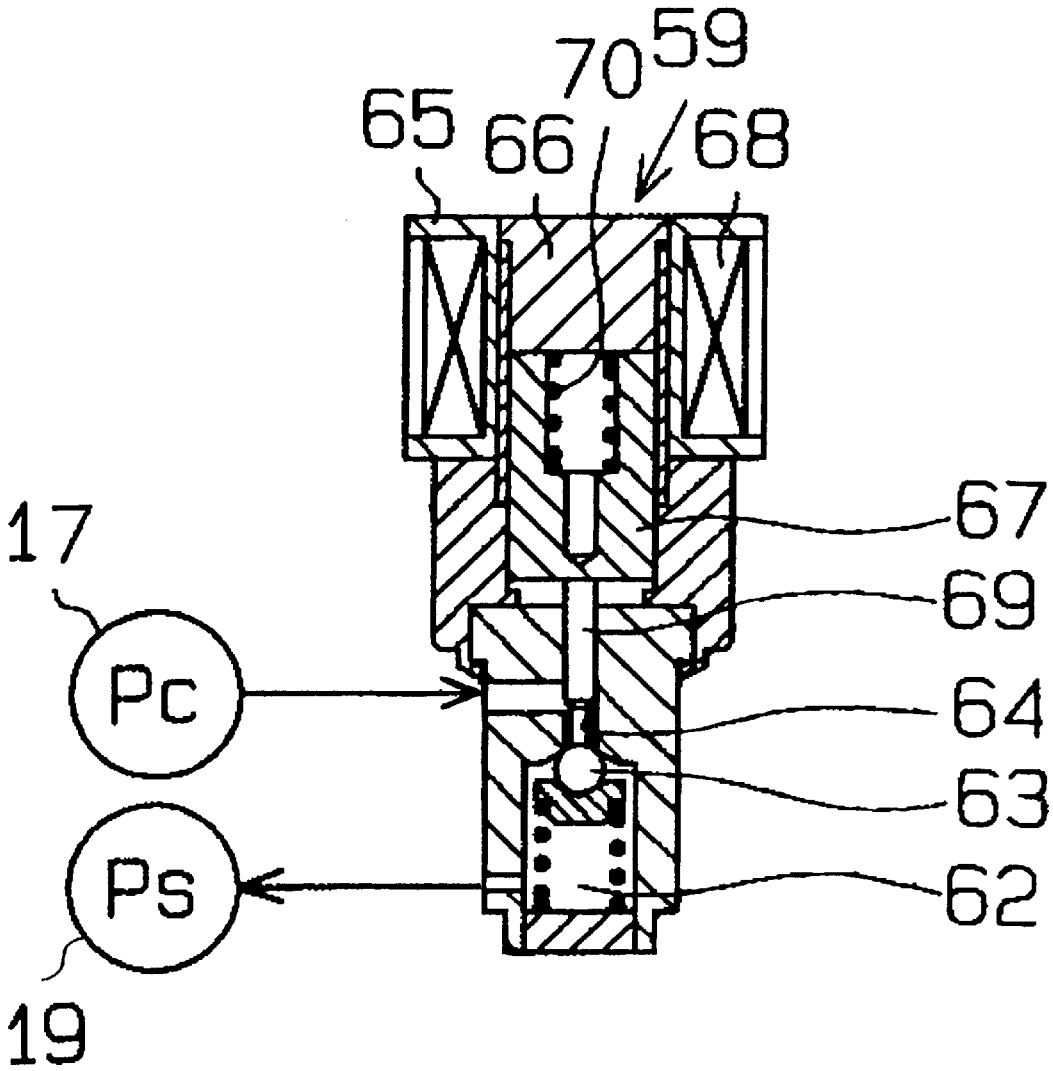
FIG. 5 is a cross-sectional view illustrating a control valve according to the present invention.

In order to change pressure in the crank chamber 17 a control valve may be disposed in the bleeding passage instead of the supply passage. The bleeding passage in this case is a control passage. As shown in FIG. 5, the control valve 59 controls an opening degree of the bleeding passage communicating the crank chamber 17 with the suction chamber 19. Ps denotes pressure in the suction chamber 19.

Figure 6:
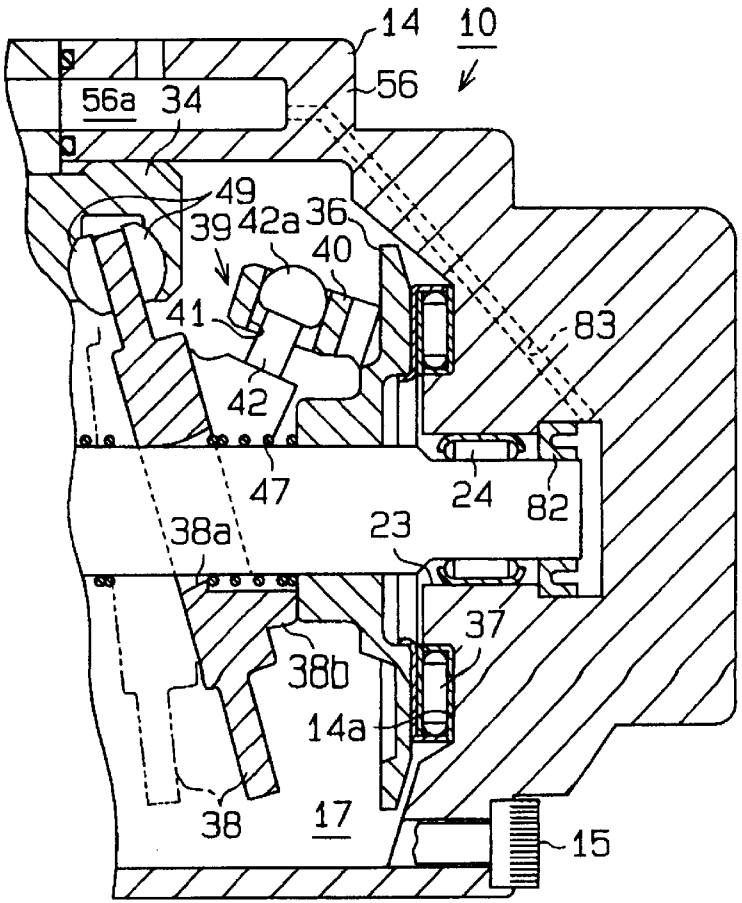
FIG. 6 is a partial cross-sectional view illustrating a rear portion of the compressor according to the present invention.

In the constitution that the control valve is arranged in the bleeding passage, a sealing ring 82 may be arranged in the recess 23 of the rear housing 14, and a passage 83 may be formed to supply discharge pressure into the recess 23, as shown in FIG. 6. The discharge pressure is added to the rear end of the drive shaft 18 by the passage 83. While the compressor 10 is being driven, the discharge pressure always acts on the rear end of the drive shaft 18. Accordingly, force against the compressive reaction force increases, and reduction of the drive force is achieved. The control of the pressure Pc adjusted by the control valve does not have a bad influence, because the sealing ring 82 seals between the pressure in the crank chamber 17 and the discharge pressure. The sealing ring 82 may be arranged to seal between the crank chamber 17 and the radial bearing 24.

According to FIG. 4, the drive shaft 18, which is isolated from the suction chamber 19 or the discharge chamber 20, protrudes from the housing 11 through the through hole 81. The discharge chamber 20 may be arranged inside the suction chamber 19. When the control valve is arranged in the bleeding passage, the control valve is easy to arrange, and the position of the arrangement may be selected from wide range.

The control valve 59 is not limited to a magnetic control valve, and may be a so-called internal control valve including a diaphragm or bellows as disclosed in Japanese Unexamined Patent Publication No. 6-123281. The diaphragm detects the suction pressure. The control valve adjusts the opening degree of the control passage by the movement of the diaphragm. In the clutchless type of compressor, however, a magnetic valve which is controllable in the exterior of the compressor is preferable.

The control valve is not limited to one disposed in either the supply passage or bleeding passage, but may be disposed in both the passage, as disclosed in Japanese Unexamined Patent Publication No. 10-54349.

Figure 7:
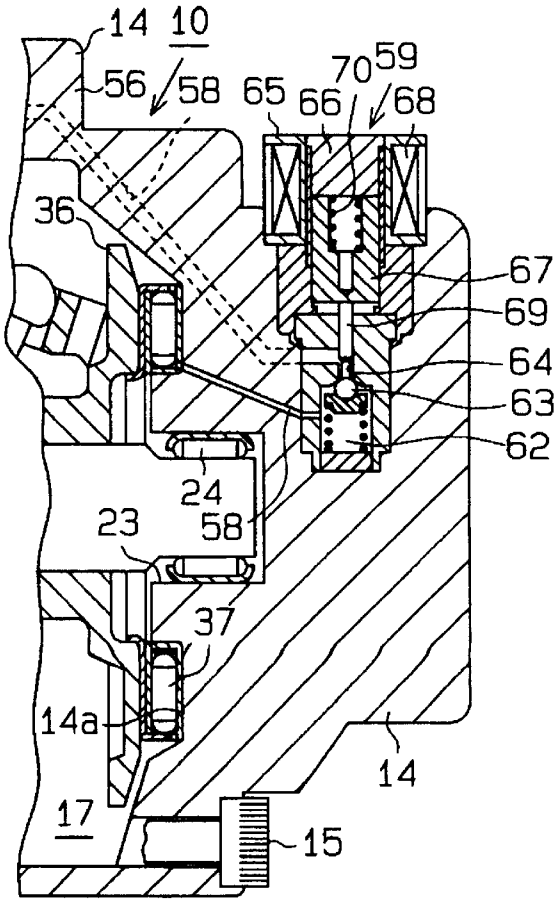
FIG. 7 is a partial cross-sectional view illustrating a rear portion of the compressor according to the present invention.

As shown in FIG. 7, the supply passage 58 may open to the crank chamber at the first thrust bearing 37. Accordingly, the first thrust bearing 37 is lubricated satisfactorily.

The lubricating passage may be formed separately from the control passage in order to lubricate the radial bearing 24 or the thrust bearing 37 satisfactorily. The lubricating passage may be arranged to communicate with the radial bearing 25.

The control valve 59 may be arranged in the front housing 12 or in the cylinder block 13.

The muffler 56 may be arranged in the front housing 12, or in the rear housing where the control valve is provided.

The inclination angle of the swash plate 38 may be changed directly by an actuator such as an electric cylinder.

In the hinge mechanism shown in FIG. 1, the guide pin 42 having the spherical portion 42*a* moves in the cylindrical guide hole 41. The hinge mechanism, however, is not limited to this constitution. The hinge mechanism may include a support arm, a swing arm and a guide pin. The support arm protrudes from the lug plate 36 and has a guide hole thereon. The swing arm is formed on the swash plate 38 to face the lug plate. The guide pin is fixed to the swing arm and inserted in the guide hole. The swash plate 38 is slidable on the drive shaft 18 and inclinable with respect to the drive shaft 18 because the guide pin slidably moves in the guide hole. The guide pin may be a simple cylindrical shape. This simple guide pin can be manufactured more easily than the guide pin having a spherical portion.

The swash plate 38 does not always need to be supported directly by the drive shaft 18 inserted in the through hole 38*a* of the swash plate 38. The swash plate may be supported by a sleeve slidably mounted on the drive shaft. The sleeve may have a support shaft or a spherical surface inclinably supporting the swash plate.

Figure 8:
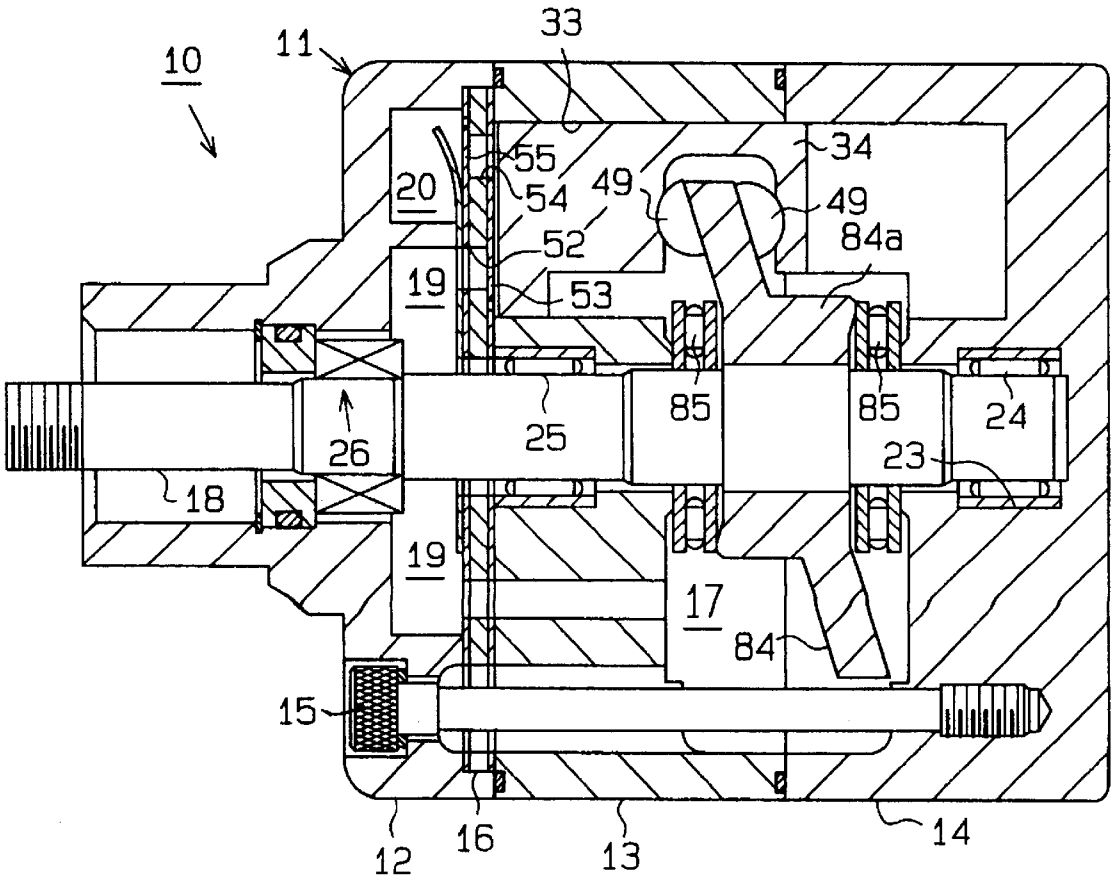
FIG. 8 is a cross-sectional view illustrating a fixed displacement compressor according to the present invention.
Figure 9:
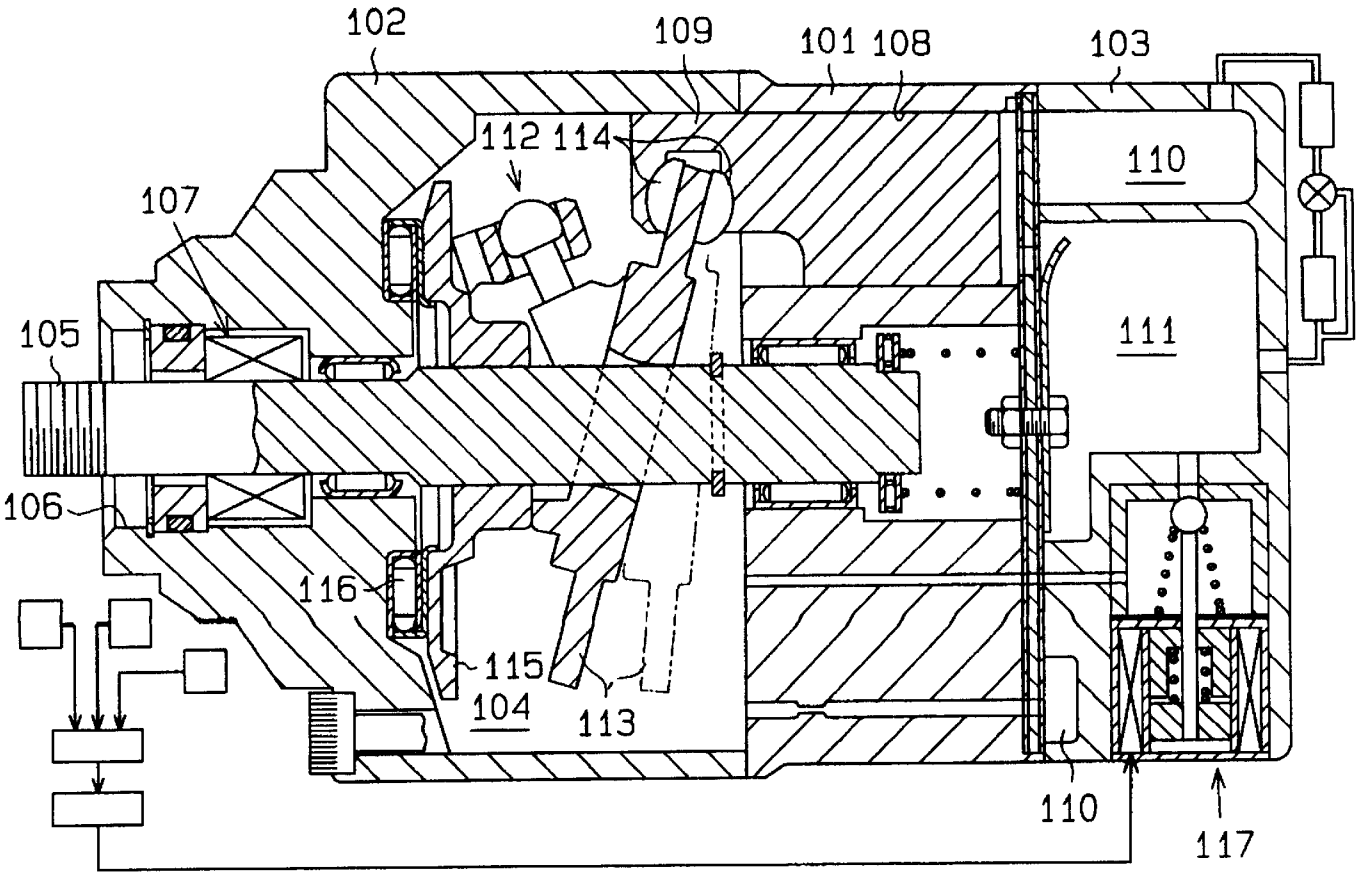
Fig. 9 (PRIOR ART)
FIG. 9 is a cross-sectional view illustrating a variable displacement compressor according to a prior art.

The present invention may be applied not only to a variable displacement compressor but to a fixed displacement compressor. As shown in FIG. 8, a swash plate 84 is integrally rotatably fixed to the drive shaft 18, and the swash plate 84 is supported by a compressor housing through a pair of thrust bearings 85 contacting respective boss portions of the swash plate 84. In this case force due to the difference between the pressure in the crank chamber 17 and the atmospheric pressure acts on the drive shaft 18 against the compressive reaction force. Accordingly, the power consumption is reduced. A sealing ring 82 and a passage 83 shown in FIG. 6 may be applied to the compressor in FIG. 8. In this case the power consumption is further reduced.

The swash plate 84 does not need to be rotated integrally with the drive shaft 18 as a fixed displacement compressor. For example, as disclosed in Japanese Unexamined Patent Publication No. 10-159723, the swash plate may be supported to be rotatable relatively with respect to the drive shaft through a radial bearing and to incline with respect to the drive shaft at a predetermined angle, and the swash plate may be oscillated without rotating integrally with the drive shaft.

Not only carbon dioxide but chloro-fluoro carbon and the like are applied as refrigerant.

A lip seal may be applied as a shaft seal so that a sliding seal surface is a cylindrical surface of the drive shaft 18. In this case, a slot to introduce lubricating oil to the sliding seal surface is preferably applied.

The present invention may be applied to a wobble type of variable displacement compressor.

Instead of the engine 51 a motor may be applied as a drive source driving a compressor provided in an electric or hybrid car for example. The compressor driven by the motor, even a fixed displacement compressor may not need a clutch between the motor and the compressor. The discharge capacity may be changed by adjusting rotational speed of the motor. Accordingly, the fixed displacement compressor functions substantially as a variable displacement compressor.

As mentioned before, the thrust load acting on the drive shaft is reduced, and the required power to drive the compressor is reduced by the present invention. The shaft seal between the pressure inside the compressor and the atmospheric pressure is also improved its own durability.

Therefore the present examples and embodiments are to be considered as illustrative and not restrictive and the invention is not to be limited to the details given herein but may be modified within the scope of the appended claims.

What is claimed is:

1. A single-headed piston type compressor comprising:

a housing including a suction chamber, a discharge chamber and a crank chamber therein;

a drive shaft rotatably supported by said housing, wherein a first end of said drive shaft protrudes from said housing, and a second end of said drive shaft is disposed within said housing, and the suction chamber of said housing is defined adjacent to the first end of said drive shaft such that said drive shaft penetrates the suction chamber and protrudes from said housing;

a cylinder bore formed in said housing, said cylinder bore being located between the crank chamber and the first end of said drive shaft;

a single-headed piston disposed in said cylinder, said piston being reciprocally movable therein;

a cam plate mounted on and integrally rotating with said drive shaft in the crank chamber, said cam plate being operatively engaged with said piston, whereby rotational movement of said drive shaft is converted to reciprocating movement of said piston through said cam plate; and a shaft seal arranged between the suction chamber and the first end of said drive shaft, thereby sealing the suction chamber.

2. A single-headed piston type compressor according to claim 1 further comprising:

a regulating surface formed in said housing, said regulating surface receiving an axial load by compressive reaction force of said piston and regulating said drive shaft positioning in the axial direction of said drive shaft; and a spring for urging said drive shaft to said regulating surface at least while the compressor stops.

3. A single-headed piston type compressor according to claim 2 further comprising means for controlling an inclination angle of said cam plate which is inclinably supported by said drive shaft, whereby a stroke of said piston is changeable in accordance with the control of said cam plate inclination angle.

4. A single-headed piston type compressor according to claim 3 further comprising:

a rotor mounted on and integrally rotating with said drive shaft; and a hinge mechanism arranged between said rotor and said cam plate.

5. A single-headed piston type compressor according to claim 4, wherein said drive shaft is inserted in an axial hole formed in said housing, the axial hole communicating the crank chamber with the suction chamber, and wherein said shaft seal is mounted in the axial hole to seal clearance between said drive shaft and said housing.

6. A single-headed piston type compressor according to claim 4, wherein said spring urges and inclines said cam plate in the direction of increasing said cam plate angle with respect to a plane perpendicular to an axis of said drive shaft, at least when the inclination angle of said cam plate is minimum.

7. A single-headed piston type compressor according to claim 6, wherein said spring is released from its contact with said cam plate when the inclination angle of said cam plate is substantially maximum.

8. A single-headed piston type compressor according to claim 6, wherein a first end of said spring contacts a thrust bearing arranged between said drive shaft and said housing.

9. A single-headed piston type compressor according to claim 1 further comprising a control passage which communicates the discharge chamber and/or the suction chamber with the crank chamber; and a control valve disposed in said control passage, said control valve adjusting an opening degree of said control passage to adjust the pressure in the crank chamber.

10. A single-headed piston type compressor according to claim 9, wherein said control passage communicates the discharge chamber with the crank chamber.

11. A single-headed piston type compressor according to claim 10 further comprising a muffler chamber arranged at a downstream of the discharge chamber, wherein said control passage communicates said muffler chamber with the crank chamber.

12. A single-headed piston type compressor according to claim 11, wherein the discharge chamber, said muffler chamber and said control valve are arranged from a first end to a second end of said housing in the axial direction in turn.

13. A single-headed piston type compressor according to claim 9, wherein said control passage is a lubricant passage.

14. A single-headed piston type compressor according to claim 3, wherein the first end of said drive shaft is always operatively connected to a drive source.

15. A single-headed piston type compressor according to claim 1 further comprising:

a lubricant passage communicating the suction chamber and/or the discharge chamber with the crank chamber; and a bearing supporting said drive shaft, said bearing being located in said lubricant passage.

16. A single-headed piston type compressor according to claim 1 further comprising a passage for adding discharge pressure to the second end of said drive shaft so that force due to the discharge pressure against compressive reaction force of said piston acts on said drive shaft.

17. A single-headed piston type compressor according to claim 1, wherein carbon dioxide is applied as refrigerant gas.

18. A single-headed piston type compressor comprising:

a housing including a front housing, a rear housing and a cylinder block provided between the front and rear housings, the front housing having a suction chamber and a discharge chamber therein, the cylinder block and the rear housing defining a crank chamber therebetween;

a drive shaft rotatably supported by said housing, said drive shaft having a first end protruding from the front housing and a second end disposed within said housing so that said drive shaft is urged frontward by pressure in said housing, wherein the suction chamber of said housing is defined adjacent to the first end of said drive shaft such that said drive shaft penetrates the suction chamber and protrudes from said housing;

a cylinder bore formed in the cylinder block, said cylinder bore connecting the crank chamber to the suction and discharge chambers of the front housing;

a single-headed piston reciprocally disposed in said cylinder bore;

a cam plate mounted on said drive shaft within said crank chamber, said cam plate being coupled with said piston and integrally rotating with said drive shaft so that rotational movement of said cam plate reciprocates said piston in said cylinder bore;

whereby compressive reaction force due to the piston reciprocation acts on said drive shaft rearward against the pressure in said housing; and a shaft seal arranged between the suction chamber and the first end of said drive shaft, thereby sealing the suction chamber.

19. A single-headed piston type compressor according to claim 18 further comprising a shaft seal sealing a clearance between the front housing and said drive shaft, said shaft seal being disposed in the suction chamber of said front housing.

* * * * *

UNITED STATES PATENT AND TRADEMARK OFFICE

CERTIFICATE OF CORRECTION

PATENT NO. : 6,544,004 B2
DATED : April 8, 2003
INVENTOR(S) : Toshiro Fujii et al.

It is certified that error appears in the above-identified patent and that said Letters Patent is hereby corrected as shown below:

Title page,
Item [56], References Cited, FOREIGN PATENT DOCUMENTS, please add
-- JP 6-123281 5/1994
JP 9-151847 6/1997
JP 10-054349 2/1998
JP 10-159723 6/1998
JP 11-107914 4/1999
JP 11-223179 8/1999
JP 11-257219 9/1999
2000-054956 2/2000 --

Signed and Sealed this

Twenty-fourth Day of August, 2004

JON W. DUDAS
*Director of the United States Patent and Trademark Office*